United States Patent [19]

Vine et al.

[11] Patent Number: 4,861,618

[45] Date of Patent: Aug. 29, 1989

[54] THERMAL BARRIER COATING SYSTEM

[75] Inventors: Raymond W. Vine, East Hartford; Keith D. Sheffler, Wethersfield; Charles E. Bevan, Colchester, all of Conn.

[73] Assignee: United Technologies Corporation, Hartford, Conn.

[21] Appl. No.: 121,029

[22] Filed: Nov. 16, 1987

Related U.S. Application Data

[62] Division of Ser. No. 925,654, Oct. 30, 1986.

[51] Int. Cl.[4] ..... B05D 1/00

[52] U.S. Cl. ..... 427/34; 427/423

[58] Field of Search ..... 427/34, 423; 428/615, 428/633, 656; 106/14.05

[56] References Cited

U.S. PATENT DOCUMENTS

| | | | |
|---|---|---|---|
| 4,248,940 | 2/1981 | Grey | 428/633 |
| 4,457,948 | 7/1984 | Ruckle | 427/34 |
| 4,535,033 | 8/1985 | Stecura | 428/633 |
| 4,585,481 | 4/1986 | Gupta | 428/656 |

*Primary Examiner*—Donald P. Walsh

*Attorney, Agent, or Firm*—Charles E. Sohl

[57] ABSTRACT

A thermal barrier coating system for the protection of nickel and cobalt base superalloys at elevated temperature comprises 7% yttria partially stabilized zirconia plasma sprayed in air on a plasma sprayed NiCoCrAlY bond coat which has been plasma sprayed in air.

1 Claim, 1 Drawing Sheet

THERMAL BARRIER COATING SYSTEM

This is a division of copending application Ser. No. 925,654, filed on Oct. 30, 1986.

TECHNICAL FIELD

The present invention relates to plasma sprayed ceramic thermal barrier coating used to protect substrates from elevated temperatures.

BACKGROUND ART

Gas turbine engines derive their thrust or other power output by the combustion of fuels. Since engine power and economy both improve with increased temperature, there has been a persistent trend in the gas turbine engine field toward increased engine operating temperatures. For many years this trend was accommodated by the development of improved materials. Whereas early gas turbine engines were based mainly on alloys derived from common steels, the modern gas turbine engine relies on nickel and cobalt base superalloys in many critical applications. It appears for the moment that property limits for metallic materials are being approached or perhaps have been reached, but the demand for increased temperature capability continues. While work is underway to develop ceramic turbine materials, this work is at a very preliminary stage and many difficulties must be overcome before ceramics play a structural role in gas turbine engines.

Not surprisingly, attempts have been made to use ceramics as coating materials to provide thermal insulation to metallic substrates and thereby permit increased engine operating temperature without substrate damage. Such attempts have met with a certain degree of success as described, nonetheless, the durability of ceramic thermal barrier coatings remains a concern because such coatings are used in man rated applications and safety considerations require maximum durability. The basic approach which has generally been taken is to apply an oxidation resistant metallic bond coat to the substrate and then to apply to this bond coat a ceramic coating, or in some cases, a mixed metal ceramic coating. Several patents have suggested the use of MCrAlY materials for the bond coat. MCrAlY materials were developed for the protective coating of metallic components to protect them from oxidation and corrosion under high temperature conditions. Such MCrAlY coatings are described, for example, in U.S. Pat. Nos. 3,676,085, 3,928,026 and 4,585,481.

The currently favored ceramic constituent is zirconia, but because zirconia undergoes a phase transformation at about 1800° F., it is necessary to make additions to the zirconia to provide a stable or at least controlled microstructure at increasing temperature.

Patents which appear particularly pertinent to this subject area include U.S. Pat. No. 4,055,705 which suggests a thermal barrier coating system using a NiCrAlY bond coat and a zirconia based ceramic coating which may contain, for example, 12% yttria for stabilization. U.S. Pat. No. 4,248,940, which shares a common assignee with the present application, describes a similar thermal barrier coating, but with emphasis on the type of thermal barrier coating in which the composition of the coating is graded from 100% metal at the bond coat to 100% ceramic at the outer surface. This patent describes the use of MCrAlY bond coats, including NiCoCrAlY, and mentions the use of yttria stabilized zirconia. U.S. Pat. No. 4,328,285 describes a ceramic thermal barrier coating using a CoCrAlY or NiCrAlY bond coat with ceria stabilized zirconia. U.S. Pat. No. 4,335,190 describes a thermal barrier coating in which a NiCrAlY or CoCrAlY bond coat has a sputtered coating of yttria stabilized zirconia on which is plasma sprayed a further coating of yttria stabilized zirconia. U.S. Pat. No. 4,402,992 describes a method for applying a ceramic thermal barrier coating to hollow turbine hardware containing cooling holes without blockage of the holes. The specifics of the coating mentioned are a NiCrAlY or a CoCrAly bond coat with yttria stabilized zirconia. U.S. Pat. No. 4,457,948 describes a method for producing a favorable crack pattern in a ceramic thermal barrier coating to enhance its durability. The coating mentioned has a NiCrAlY bond coat and a fully yttria stabilized zirconia coating. U.S. Pat. No. 4,481,151 describes another ceramic thermal barrier coating in which the bond coat comprises NiCrAlY or CoCrAlY, but wherein the yttrium constituent may be replaced by ytterbium. The ceramic constituent is partially yttria or ytterbium stabilized zirconia. U.S. Pat. No. 4,535,033 is a continuation-in-part application of the previously mentioned U.S. Pat. No. 4,4481,151 and deals with a ceramic thermal barrier coating in which zirconia is stabilized by ytterbia.

DISCLOSURE OF INVENTION

It is an object of this invention to disclose a ceramic thermal barrier coating having surprisingly enhanced durability relative to similar ceramic thermal barrier coatings known in the art. According to the invention, a NiCoCrAlY bond coat is plasma sprayed, in air, on the surface of the substrate to be protected, after the substrate surface has been properly prepared. The ceramic consists of yttria partially stabilized zirconia, containing about 7% yttria to provide the proper degree of stabilization, plasma sprayed in air on the previously applied NiCoCrAlY bond coat. The resultant coating has surprisingly enhanced durability relative to similar thermal barrier coatings which employ other types of MCrAlY bond coats and ceramic top coats. The use of 7% yttria stabilized zirconia permits the coating to be used at elevated temperatures compared to other thermal barrier coatings which have employed other zirconia stabilizers or other amounts of yttria. The use of air plasma spraying as opposed to low pressure chamber plasma spraying eliminates substrate preheating and post spray heat treatment. The invention is particularly pertinent to coating of sheet metal parts which are prone to distortion in heat treatment.

The foregoing and other objects, features and advantages of the present invention will become more apparent from the following description of the preferred embodiments and accompanying drawings.

BEST MODE FOR CARRYING OUT THE INVENTION

Figure 1:
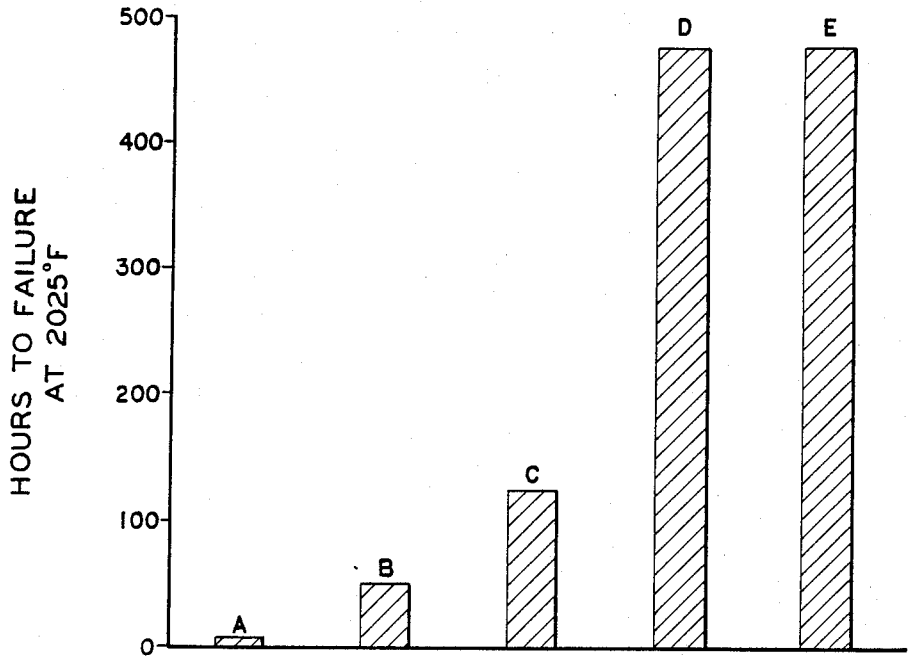
FIG. 1 is a bar chart depicting the hours to failure in cyclic testing at 2025° F. of various combinations of metallic bond coats and ceramic outer coatings applied to sheet metal samples.

The benefits of the invention are clearly illustrated in FIG. 1. FIG. 1 depicts the relative life of several different ceramic thermal barrier coatings in a very severe test performed at 2025° F. The test comprised a six-minute thermal cycle in which the coated substrate (a sheet metal sample) was heated from about 200° F. to about 2025° F. in two minutes, held for two minutes at 2025° F. and was then forced air cooled in two minutes back down to about 200° F. This is a severe test employing conditions which are more demanding than those which would normally be encountered in a gas turbine engine. The figure illustrates the time to failure in hours, the number of cycles is obtained by multiplying the number of hours by 10.

The left-most bar (A) on the chart is a coating which has been used commercially in gas turbine engines at temperatures up to about 1800° F. This coating consists of zirconia (fully) stabilized with about 21% magnesia applied on a CoCrAlY (23%Cr, 13%Al, 0.65%Y bal Co) bond coat. The left-most coating is a graded coating so that the CoCrAlY composition diminishes through the thickness of the coating from 100% at the bond coat to 0% at the outer coat at the outer surface. The remaining coatings on the chart are non-graded two-layer coatings. The graded coating (A), which displays the shortest life, failed in the graded portion of the coating as a consequence of oxidation of the finely divided metallic constituent which causes swelling of the coating and subsequent spallation. This coating fails in an abnormally short time because of the nature of the coating failure and the severe test conditions, the coating has a normal maximum use temperature of about 1800° F.

The remaining coatings on the chart fail by spalling and cracking occurring within the ceramic constituent. Spallation at the interface between the ceramic and the bond coat is not a problem. This analysis of the failure mode in this type of ceramic coating would lead one to suppose that the bond coat material would not play a significant role in coating performance, but rather the coating performance would essentially be determined by the nature of the ceramic material. As will be seen subsequently, this is surprisingly not the case.

The next bar (B) on the chart comprises the same ceramic constitutent, zirconia stabilized with 21% magnesia, but this is a two-layer coating in which a 100% ceramic layer is applied to a bond coat. In this instance, the bond coat is a simple alloy of nickel-22 weight percent aluminum.

The third bar (C) on the chart uses the same 21% magnesia stabilized zirconium on a NiCoCrAlY bond coat (nominal composition 23%Co, 17%Cr, 12.5%Al, 0.45%Y bal Ni). This coating had both the bond coat and the ceramic layer deposited by plasma spraying in air. Interestingly enough, the third coating on the chart displays about a 2x improvement in life over the previously mentioned 21% MgO stabilized zirconia coating on Ni-22%Al coating illustrating that the bond coat does affect coating performance. All of the coatings based on 21% magnesia stabilized zirconia appear to fail as a result of destabilization of the ceramic over time by volatilization of the less stable magnesia material at elevated temperatures and/or the effects of microscopic thermal mechanical stresses/racheting with the ultimate formation of the monoclinic crystalline phase of zirconia at temperatures in excess of about 1900° F. The monoclinic crystal phase is the non-thermal cyclable zirconia that is unstable in gas turbine applications. The last two coatings described in the figure used zirconia partially stabilized with about 7% yttria, this type of stabilized zirconia does not undergo thermal degradation until temperatures in excess of about 2200° F. are encountered.

Figure 2:
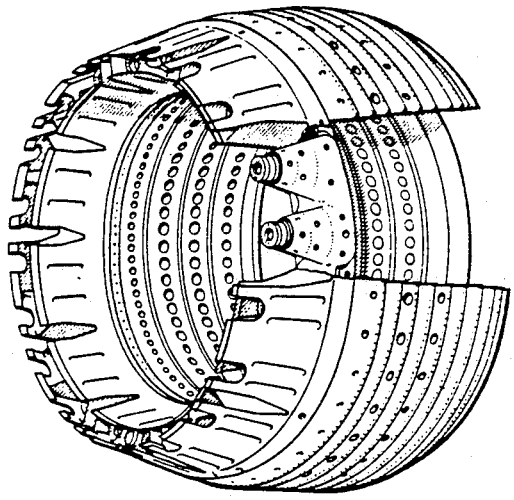
FIG. 2 is a schematic drawing of a gas turbine combustion chamber.

The fourth bar (D) on the chart uses the 7% yttria partially stabilized zirconia on a NiCoCrAlY (23%Co, 17%Cr, 12.5%Al, 0.45%Y bal Ni) bond coat, but differs from the other coatings in that the metallic constituents were applied by low-pressure plasma spraying, spraying in a chamber in which the gas pressure was reduced to about 5 millimeters of mercury before spraying. This type of low pressure plasma spraying has been shown in the past to provide substantially enhanced thermal barrier coatings containing less oxides and porosity in the metallic bond coating and having better integrity and adherence. One feature of chamber spraying is that the substrate must be preheated to 1600° F.–1800° F. before spraying. This is practical for 3"–6"turbine blades but impractical for complex sheet metal combustors whose dimensions are on the order of 1–3 feet and which are complex warpage prone assemblies of thin (0.020–0.040 in) sheet metal pieces. FIG. 2 is a schematic illustration of a gas turbine combustor. Also, plasma spraying metallic bond coating, such as NiCoCrAlY, under reduced atmospheric pressures leads to the formation of a weak metallic substrate-metallic bond coating interface which requires a post high temperature heat treatment to form a metallurgical bond between the substrate and bond coat. The heat treatment means that sheet metal constituents which are prone to warpage cannot receive this type of coating. The necessity of applying this type of coating in a vacuum chamber thus mitigates against usage of this coating on larger sheet metal components, such as combustors which are inconveniently large for the readily available low pressure plasma spraying systems. This type of coating, applied in a low pressure plasma spray system with subsequent secondary heat treatment, has been used commercially with some success, but has been limited in application to use on small turbine blades and vanes having substantial structural strength. By way of contrast, in air plasma spraying, the substrate is held at temperatures below 500° F. and no post spray heat treatment is necessary. Prior air spray experience had suggested that the results would be noticeably inferior to low pressure chamber sprayed parts. Chamber sprayed bond coats contain less than 0.5% oxide content and about 1%–2% porosity. Air sprayed coatings contain 3%–5% oxides and 5%–15% porosity.

The final bar (E) on the chart illustrates the invention coating performance. It can be seen that the invention coating performance is fully equivalent to that of the best prior coating despite the fact that the invention coating is applied in air and does not receive any subsequent heat treatment.

The present invention derives some of its beneficial attributes from the use of the NiCoCrAlY bond coat. This appears to be the case despite the fact that failure occurs in the ceramic coating rather than at the interface between the bond coat and the ceramic coating. The exact mechanism by which the use of a NiCoCrAlY bond coat benefits coating performance is not fully understood, but is undoubtedly related to the enhanced ductility of NiCoCrAlY coatings (as described in U.S. Pat. No. 3,928,026) relative to the NiCrAlY and CoCrAlY bond coats which the art has generally favored up until now. It is also the case that the ceramic constituent of the present invention, namely, zirconia stabilized with 6% to 8% yttria, is more durable than some of the zirconia coatings which the prior art has used which have been stabilized to different degrees by different additions. This can be seen on the graph by the comparison between the magnesia stabilized zirconia and yttria stabilized zirconia, both of which were applied on a NiCoCrAlY bond coat. Other testing indicates that, tested at 2000° F., 7% yttria stabilized zirconia is about twice as durable as 12% yttria stabilized zirconia and about 5× as durable as 20% yttria (fully) stabilized zirconia.

The present invention can be applied to superalloy substrates as follows. There is generally no limit on the substrate composition provided, of course, it has the requisite mechanical properties at the intended use temperature. The substrate surface must be clean and properly prepared and this is most easily accomplished by grit blasting the surface to remove all oxide and other contaminants and to leave behind a slightly roughened surface of increased surface area to enhance bonding of the metallic bond coat to the substrate. The bond coat is applied to the substrate by plasma spraying. The plasma spray parameters are the same as those described below for the ceramic constituent. The bond coat material is NiCoCrAlY having a composition falling within the following range 15–40%Co, 10–40%Cr, 6–15%Al, 0.7%Si, 0–2.0%Hf, 0.01–1.0%Y, bal essentially Ni and has a particle size which is preferably within the range −170+325 US std. sieve. The bond coat preferably has a thickness of from 0.003–0.015 inches. There is no benefit to be obtained by any increase in bond coat thickness. Any bond coat thickness less than about 0.003 inch is risky because plasma sprayed coatings of thicknesses much less than about 0.003 inch tend to leave exposed substrate areas and the ceramic coating will not properly bond to the exposed substrate. This leads to early catastrophic coating failure by spallation. The plasma spraying of the bond coat to the prepared substrate surface is preferably performed in a timely fashion and preferably no more than about two hours elapses to minimize the possibility of substrate surface contamination, for example, by oxidation.

The bond coat coated substrates are then adapted to receive a coating of zirconia stabilized with 6%-8% yttria. Preferably the particle size to be sprayed is 60 micron (avg), the power flow rate is 50 gm/min and the plasma spraying conditions are 35 volts and 800 amps using a mix of argon helium as a carrier gas in a Plasmadyne gun held about 3 inches from the surface and translated about 74 ft/min relative to the surface. Again, the application of the ceramic coating to the bond coated substrate is preferably performed within about two hours so as to minimize contamination and other problems.

Although this invention has been shown and described with respect to a preferred embodiment, it will be understood by those skilled in the art that various changes in form and detail thereof may be made without departing from the spirit and scope of the claimed invention.

We claim:

1. A method of applying a durable thermal barrier coating to a metallic substrate including the steps of a) providing a clean substrate surface b) depositing a metallic bond coat having a composition consisting of 15–40%Cr, 6–15%Al, 0–2%Hf, 0–7%Si, 0.01–1.0%Y bal essentially Ni by plasma deposition in air to a thickness of 0.005–0.015 in.

c) depositing a ceramic coating of zirconia stabilized with 6–8wt% yttria by plasma deposition in air to a thickness of 0.010–0.015 in.

* * * * *

UNITED STATES PATENT AND TRADEMARK OFFICE

CERTIFICATE OF CORRECTION

PATENT NO. : 4,861,618

DATED : August 29, 1989

INVENTOR(S) : Raymond W. Vine; Keith D. Sheffler; and Charles E. Bevan

It is certified that error appears in the above-identified patent and that said Letters Patent is hereby corrected as shown below:

Claim 1 should read as follows:

--1. A method of applying a durable thermal barrier coating to a metallic substrate including the steps of a) providing a clean substrate surface b) depositing a metallic bond coat having a composition consisting of 15-40%Co, 10-40%Cr, 6-15%Al, 0-2%Hf, 0-7%Si, 0.01-1.0%Y bal essentially Ni by plasma deposition in air to a thickness of 0.005-0.015 in.

c) depositing a ceramic coating of zirconia stabilized with 6-8 wt% yttria by plasma deposition in air to a thickness of 0.010-0.015 in.--

Signed and Sealed this

Twenty-seventh Day of March, 1990

*Attest:*

JEFFREY M. SAMUELS

*Attesting Officer*

*Acting Commissioner of Patents and Trademarks*